US006730870B1

(12) United States Patent
Werner

(10) Patent No.: US 6,730,870 B1
(45) Date of Patent: May 4, 2004

(54) FLAT BED SORTER

(76) Inventor: Todd C. Werner, 12050 49th St. North, Clearwater, FL (US) 33762

( * ) Notice: Subject to any disclaimer, the term of this patent is extended or adjusted under 35 U.S.C. 154(b) by 58 days.

(21) Appl. No.: 10/065,088

(22) Filed: Sep. 16, 2002

(51) Int. Cl.[7] ..... B07C 5/38

(52) U.S. Cl. ..... 209/584; 209/900; 414/791.2; 270/52.01; 270/58.01; 270/59; 270/58.23; 271/225; 271/234; 271/239

(58) Field of Search ..... 209/900, 584; 414/791.2; 271/225, 234, 239, 245, 246, 253; 270/52.01, 58.01, 59, 58.23

(56) References Cited

U.S. PATENT DOCUMENTS 3,880,420 A * 4/1975 Martin ..... 271/184
3,915,785 A * 10/1975 Muller ..... 156/351
4,201,377 A * 5/1980 Honegger ..... 271/225
4,314,644 A * 2/1982 Stocker ..... 209/569
4,328,064 A * 5/1982 Miller et al. ..... 156/558
5,149,076 A * 9/1992 Stenz ..... 271/2
5,238,120 A * 8/1993 Ballestrazzi et al. ..... 209/539
5,683,078 A * 11/1997 Schieck ..... 271/250
6,241,460 B1 * 6/2001 Werner ..... 414/798.2
6,406,014 B1 * 6/2002 Reist ..... 271/3.24

FOREIGN PATENT DOCUMENTS

DE 4243986 A1 * 6/1994 ..... B65H/5/34

* cited by examiner

*Primary Examiner*—Donald P. Walsh
*Assistant Examiner*—Jonathan R Miller
(74) *Attorney, Agent, or Firm*—Ronald E. Smith; Smith & Hopen, P.A.

(57) ABSTRACT

Large items such as magazines or large envelopes lie flat upon and are transported by a first conveyor in a first, transverse direction until they sequentially encounter a frustoconical member rotatably mounted to a back wall. A second conveyor is disposed normal to the first conveyor so that it transports the items that have encountered the frustoconical member in a second direction normal to the first. A rotatably mounted barrier has a first, retracted position where it does not interfere with items approaching the frustoconical member and a second, deployed position where it stops the items short of the frustoconical member. The position of the barrier is controlled by information concerning postal routes. The items are sorted into sharply defined groups that are transversely staggered with respect to one another.

20 Claims, 3 Drawing Sheets

FLAT BED SORTER

BACKGROUND OF INVENTION

1. Field of the Invention

This invention relates, generally, to machines that sort envelopes. More particularly, it relates to a high speed flat bed sorter.

2. Description of the Prior Art

Businesses that mail large quantities of envelopes can save postage expenses by pre-sorting the envelopes by ZIP codes, carrier routes, and so on.

One common way to sort envelopes is to momentarily increase the speed of a conveyor belt carrying envelopes after a group of envelopes has been sorted. The momentary increase in speed after each grouping creates a physical separation between grouped envelopes so that a person unloading the envelopes visually observes the physical separation and collects as a unit only those envelopes that are grouped together.

This method works in a satisfactory manner at low conveyor belt speeds, but its performance becomes unacceptable at high speeds. Typically, at higher speeds an ambiguity is created by one or more envelopes that lie between contiguous groups. The operator is then unsure as to which group such intermediate envelope or envelopes belongs. Moreover, the repeated speeding up and slowing down of the belt prevents sorting at extremely high speeds. It also wears out the machinery and requires frequent maintenance and adjustment of parts.

Business-size envelopes are best sorted while held in a vertical plane, as disclosed in U.S. Pat. No. 6,241,460, entitled "Offset Sorter For Envelopes," to the present inventor, which disclosure is hereby incorporated by reference into this disclosure.

However, large envelopes or magazines cannot easily be maintained in a vertical plane because they lack rigidity and collapse under their own weight. Accordingly, the inventive apparatus disclosed in the incorporated disclosure is not the optimal apparatus for sorting such large envelopes or magazines, even though it can be used for such sorting if necessary.

What is needed, then, is an improved apparatus that sorts large envelopes, magazines, and the like, while they are lying flat on a conveyor means. The needed means would eschew the technique of increasing the speed of a conveyor belt between groups of items to physically separate them from one another. Moreover, the needed apparatus would operate at speeds heretofore unattainable yet would have less maintenance requirements than slower devices.

However, in view of the prior art considered as a whole at the time the present invention was made, it was not obvious to those of ordinary skill in the pertinent art how the identified needs could be fulfilled.

SUMMARY OF INVENTION

The longstanding but heretofore unfulfilled need for an improved flat bed sorter is now met by a new, useful, and nonobvious apparatus for sorting items to be mailed by grouping them into visually ascertainable distinct groups. The items are disposed in a generally horizontal plane because they are large, flexible items to be mailed such as large envelopes, magazines, and the like. The novel structure includes a first conveyor means for transporting the items along a first path of travel. A back wall is disposed in blocking relation to the first path of travel and a rotating frustoconical member is mounted for rotation to said back wall so that items following the first path of travel encounter the rotating frustoconical member and are constrained against further movement along the first path of travel. A second conveyor means transports the items along a second path of travel normal to the first path of travel. The second conveyor means has a first end disposed in cooperative relation to the back wall so that said items encountering the rotating frustoconical member are transported by the second conveyor means along the second path of travel.

A movably mounted barrier means is disposed in alignment with the first conveyor means and in spaced apart relation to the back wall. The barrier means has a first, raised position disposed in vertically spaced apart relation to the first conveyor means so that items following the first path of travel are unimpeded by the barrier means and therefore enter into abutting relation to the frustoconical member mounted for rotation on back wall and are carried along the second path of travel by the second conveyor means.

The barrier means has a second, lowered position disposed in blocking relation to items carried by the first conveyor means so that items following the first path of travel encounter said barrier means before reaching the rotating frustoconical member mounted to the back wall and are impeded from reaching the rotating frustoconical member. The items are then transported along the second path of travel by the second conveyor means. A control means alternately raises and lowers the barrier means in response to predetermined input data relating to postal routes. In this way, said items are sorted into transversely staggered groups so that the groups are clearly and unambiguously distinguishable from one another.

In a preferred embodiment, the barrier means has a conical shape. Although the barrier means could be provided in the form of a single cone-shaped member, the preferred structure includes a pair of cone-shaped members mounted in longitudinally spaced apart relation to one another so that items abutting such cone-shaped members are positioned substantially squarely relative to the first conveyor means. Where a single cone-shaped member is employed, an auxiliary alignment means such as a fixed position guide rail for aligning the trailing end of each item is employed.

The cone-shaped member or members are rotatably mounted to a mounting rod. A pair of transversely disposed, longitudinally spaced apart side walls are secured to opposite ends of the back wall. The mounting rod is disposed in interconnecting relation to the side walls and is supported at its opposite ends by said side walls. The mounting rod is rotatably mounted relative to the side walls so that said mounting rod is rotatable about its longitudinal axis of rotation. The cone-shaped member or members are secured to the mounting rod for conjoint rotation therewith.

A computer-controlled control means raises and lowers the barrier means in response to data containing information about postal routes so that the items are sorted into groups where each group includes items that share a predetermined postal designation. The control means may include a cylinder having a plunger that is connected to a linkage that engages the mounting rod so that actuation of the plunger in a first, retracted direction rotates the mounting rod in a first direction, thereby lifting the barrier means and so that actuation of the plunger in a second, extended direction rotates the mounting rod in a second direction opposite to the first direction, thereby lowering the barrier means.

A primary object of the invention is to provide a constant conveyor speed apparatus for sorting horizontally disposed large envelopes or magazines into distinctly separate groups.

A closely related object is to attain the foregoing object with a device that staggers each group transversely relative to its contiguous groups.

Another closely related object is to provide a device that is capable at operating at speeds in excess of twelve thousand items per hour.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
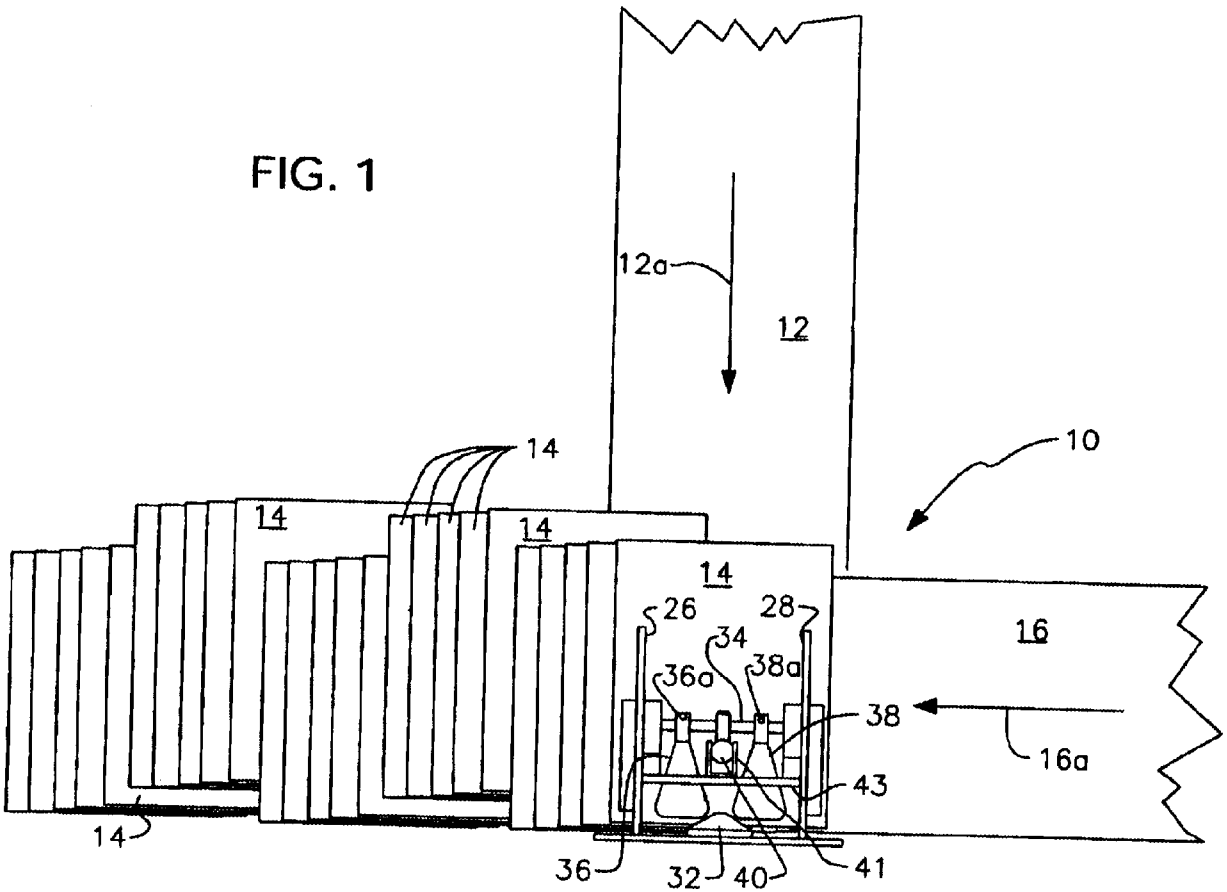
FIG. 1 is a top plan view of the novel flat bed sorter and includes a view of mailable items exiting the sorter in transversely staggered array.

Referring now to FIG. 1, it will there be seen that the reference numeral 10 denotes an illustrative embodiment of the present invention as a whole.

A first conveyor means 12 delivers relatively large items 14 to be sorted to a second conveyor means 16 disposed substantially normal to first conveyor means 12. For convenience, first conveyor means and all parts of the novel apparatus parallel thereto are deemed to be transversely disposed. Second conveyor means 16 and all parts of the novel apparatus parallel thereto are deemed to be longitudinally disposed.

If they are envelopes, items 14 have been filled with inserts, sealed and addressed for delivery by suitable means, not shown. If they are magazines or similar articles, they have been sealed against opening and addressed for delivery. Due to their large size and flexibility, items 14 are lying flat while conveyed on said first and second conveyor means.

Novel flat bed sorter 10 is positioned in alignment with the discharge end of first conveyor means 12 and at the side or longitudinal edge of second conveyor means 16. First conveyor means 12 stops just short of second conveyor means 16; items 14 carried by said first conveyor means in the direction indicated by directional arrow 12*a* enter into novel sorter 10 under the momentum imparted to them by first conveyor means 12.

In a first embodiment, sorter 10 includes an upstanding back wall 18 positioned substantially normal to the path of travel 12*a* of items 14 transported by first conveyor means 12 and substantially parallel to the path of travel 16*a* of items 14 transported by second conveyor means 16. Accordingly, back wall 18 stops items 14 as they are discharged from first conveyor means 12 and prevents them from continuing to travel along path of travel 12*a*. Upon encountering back wall 18, items 14 are transported by second conveyor means 16 along path of travel 16*a* which is substantially perpendicular to the path of travel 12*a* of the first conveyor means 12. It should therefore be understood that back wall 18 is common to prior art means for changing the direction of travel of items exiting a first conveyor means and entering a second conveyor means where the respective paths of travel of the first and second conveyor means are substantially perpendicular to one another.

Sorter 10 further includes a pair of side walls 26, 28 that are substantially parallel to one another and substantially perpendicular to back wall 18. Said side walls 26, 28 are secured to opposite ends of back wall 18. Accordingly, they extend transversely relative to the path of travel 16*a* of second conveyor means 16. As depicted in FIGS. 2–5, their respective lowermost edges 26*a*, 28*a* are vertically spaced apart from second conveyor means 16 by a distance greater than the highest stack height of items 14 that will be transported by second conveyor means 16 so that said side walls do not interfere with the transportation of items 14.

In FIGS. 2–5, side plate 28 is removed to enable viewing of the remaining parts of sorter 10.

A flexible deflector band 30 is secured as at 31 to each side wall 26, 28 and a free distal end thereof extends below lowermost edge 26*a* of side wall 26 into the path of travel 12*a* of items 14 arriving into sorter 10 from first conveyor means 12. Items 14 encounter said deflector band 30 prior to encountering back wall 18. Deflector band 30 provides a frictional engagement of each item 14 to slow its speed just prior to its contact with said back wall 18. This inhibits bouncing of the items off said back wall.

In a second, preferred embodiment, frustoconical member 32, mounted at the lower end of back wall 18, at the center thereof as indicated in FIG. 1, prevents items 14 from reaching back wall 18 and imparts a small amount of staggering to items 14 as indicated by reference numeral 32*a*. The staggering is seen in top view in FIG. 1 and in side elevation in FIGS. 2–5. Frustoconical member 32 rotates in the direction of travel of second conveyor means 16 at an angular velocity equal to the linear velocity of said second conveyor means 16 so that items 14 remain perpendicular to back wall 18 as they travel along second conveyor means 16.

Although only one frustoconical member 32 is depicted, it should be understood that two or more frustoconical members 32 could be provided as may be required by differing size items 14.

If frustoconical member or members 32 are not provided, as in the prior art, items 14 bounce haphazardly from back wall 18 as they are delivered by first conveyor means 12 to second conveyor means 16 and the orderly staggering achieved in this invention is not attained.

Each side wall 26, 28 is apertured to rotatably receive opposite ends of a mounting rod 34. As perhaps best understood in connection with FIG. 1, mounting rod 34 is longitudinally disposed, i.e., it is parallel to back wall 18 and to the path of travel 16*a* of second conveyor means 16.

A pair of cones 36, 38 (FIG. 1), having non-conical bases 36*a*, 38*a*, respectively, are tightly secured to mounting rod 34 for conjoint rotation therewith.

Figure 2:
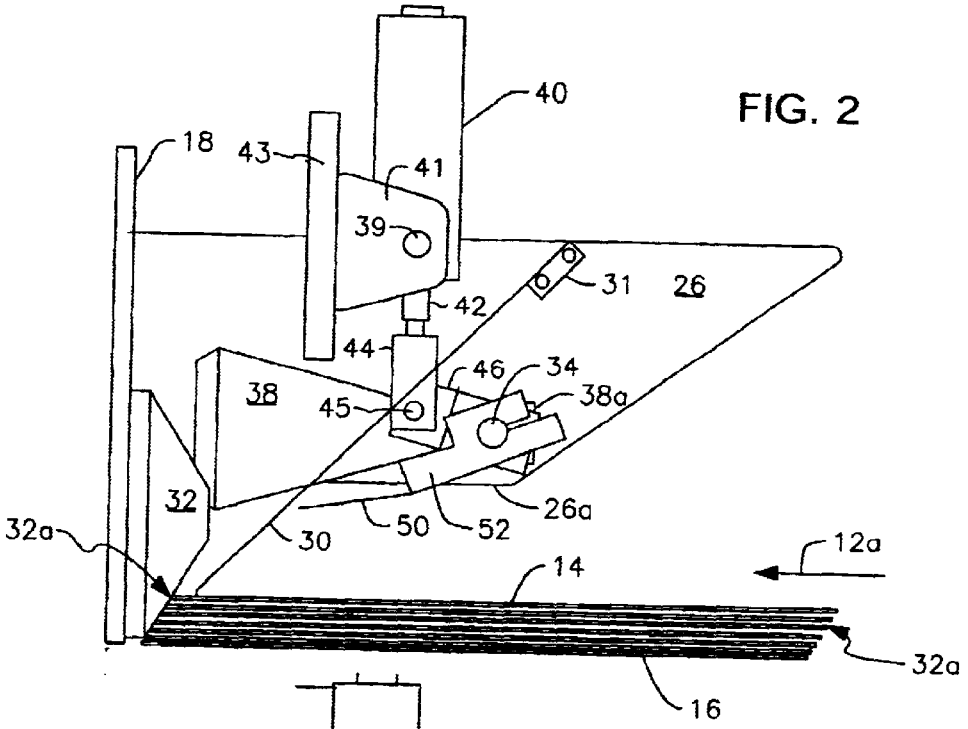
FIG. 2 is a side elevational view of the novel sorter when the pivotally mounted barrier means is in its raised position at the beginning of a sorting job.
Figure 3:
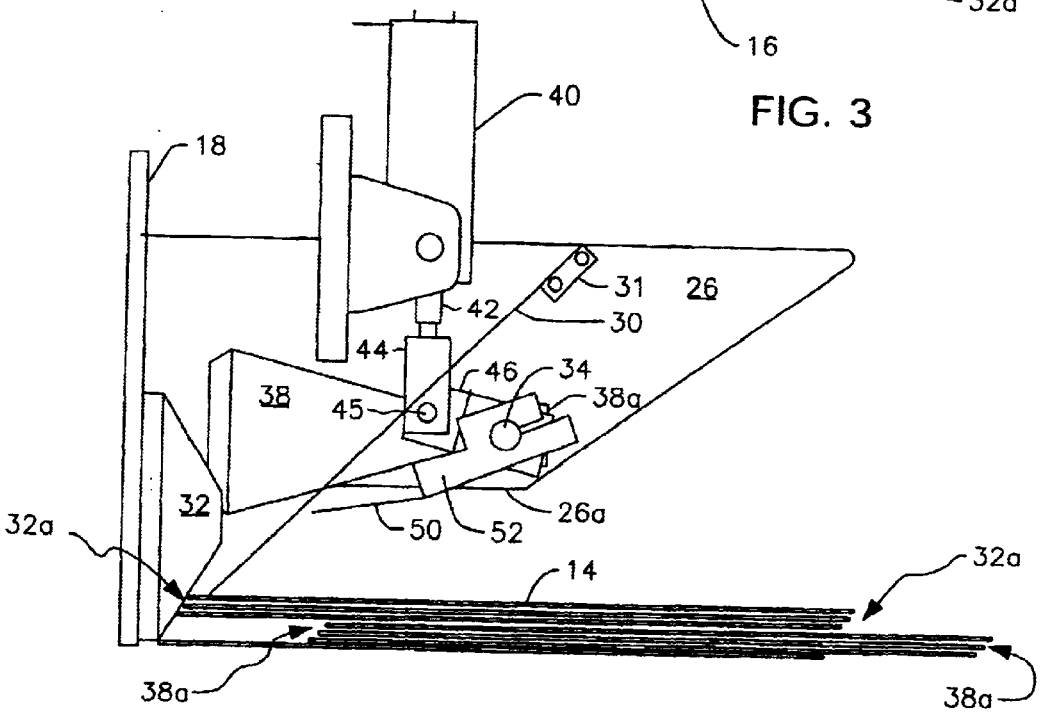
FIG. 3 is a side elevational view of the novel sorter when the pivotally mounted barrier means is in its raised position after having completed at least one operating cycle.

Rotation of mounting rod 34 about its longitudinal axis of symmetry is under the control of a computerized control means that governs the operation of a pneumatic cylinder 40 having plunger 42. Plunger 42 is connected to link 44 that is pivotally connected as at 45 to link 46 and said link 46 is clampingly engaged to mounting rod 34. Accordingly, when plunger 42 is retracted, link 44 lifts link 46 and said link 46 rotates mounting rod in a clockwise direction when viewed in the FIGS. 2–5 position, thereby causing cones 36, 38 to rotate in the clockwise direction into their respective "up" or "raised" positions as depicted in FIGS. 2 and 3.

Figure 4:
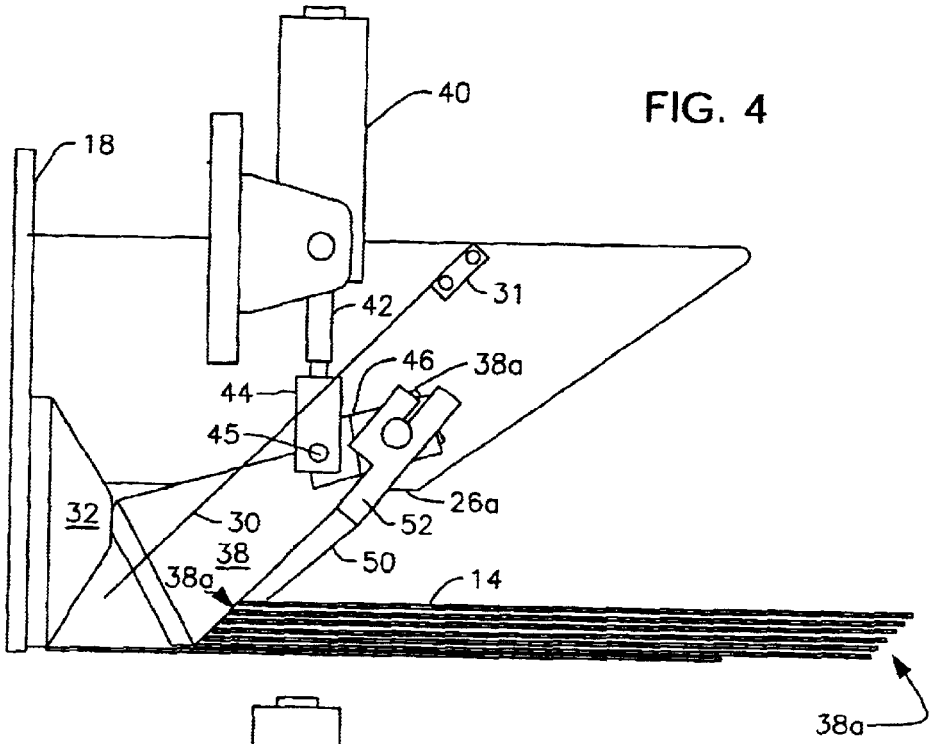
FIG. 4 is a side elevational view of the novel sorter when the pivotally mounted barrier means is in its lowered position at the beginning of a sorting job.
Figure 5:
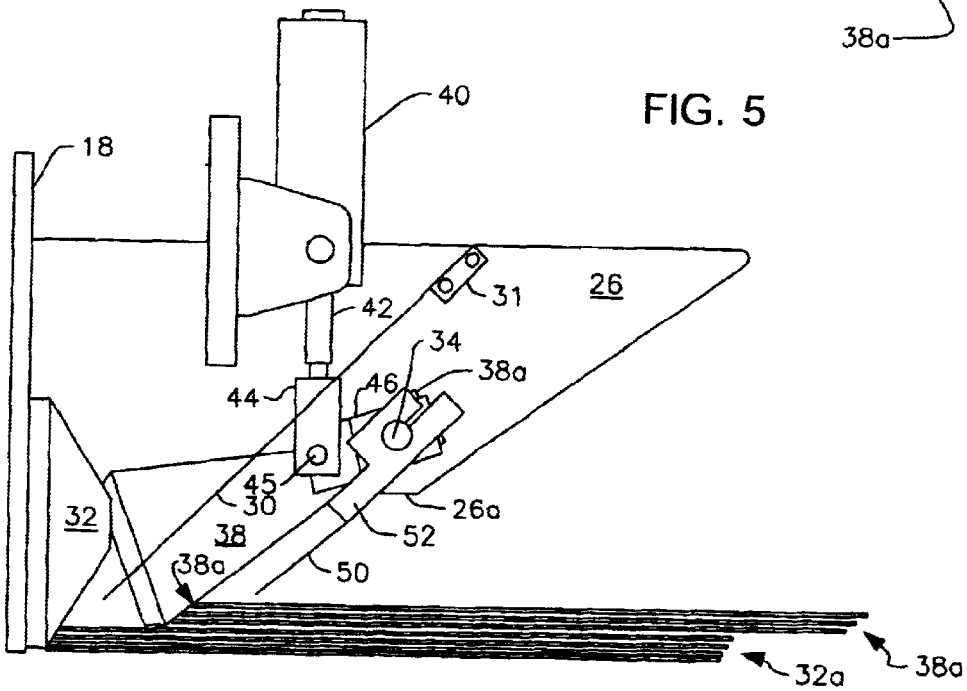
FIG. 5 is a side elevational view of the novel sorter when the pivotally mounted barrier means is in its lowered position after having completed at least one operating cycle.

When plunger 42 is extended, as depicted in FIGS. 4 and 5, link 44 rotates link 46 and hence mounting rod 34 and cones 36, 38 in a counterclockwise direction and cones 36, 38 are thus rotated into their respective "down" or "lowered" positions.

Deflector band 50 is a flexible member that extends from brake base 52 which is also secured to mounting rod 34 for conjoint rotation therewith. Thus, deflector band 50 is vertically spaced above items 14 in non-interfering relation therewith when brake base 52 is in its "up" or "raised" position as depicted in FIGS. 2 and 3. However, when brake base 50 is in its "down" or "lowered" position as depicted in FIGS. 4 and 5, deflector band 50 interferes with items 14 as they approach cones 36, 38, thereby slowing down said items just before they contact said cones. Thus it is understood that deflector band SO performs the same function for items striking cones 36, 38 as deflector band 30 performs for items striking frustoconical member 32.

Cylinder 40 is preferably a pneumatic cylinder as mentioned, but it could also take the form of a hydraulic cylinder or other suitable actuator. Cylinder 40 is controlled by a computer control means, not shown, that includes postal routing data that determines the desired sorting of items 14.

There are numerous ways to mount cylinder 40 in its operable position. In this preferred embodiment, cylinder 40 is pinned as at 39 (FIGS. 2–5) to a "U"-shaped bracket 41that is secured mid-length of horizontal, longitudinally disposed mounting plate 43 that spans side walls 26, 28, as perhaps best understood in connection with FIG. 1.

When mounting rod 34 is in its first position of rotational adjustment, as depicted in FIGS. 2 and 3, cones 36, 38 are positioned in spaced apart relation to second conveyor means 16 and items 14 transported thereby. Thus, they do not influence the position of items 14 as they exit first conveyor means 12 and enter into novel sorter 10. Items 14 therefore are braked by deflector band 30 and come to rest in abutting relation to back wall 18 (first unillustrated embodiment) or frustoconical member or members 32 (second embodiment). The items are then transported in a longitudinal direction by second conveyor means 16 as perhaps best understood in connection with FIG. 1. Again, frustoconical member or members 32 rotate at an angular velocity that matches the linear velocity of second conveyor means 16.

When mounting rod 34 is in its second position of rotational adjustment, as depicted in FIG. 4, cones 36, 38 are disposed in abutting relation to second conveyor means 16 if the machine is at start-up, i.e., if no items have yet entered sorter 10. Thus, when the machine commences operation, the first items 14 to enter sorter 10 are braked by flexible braking means 30 and then abut cones 36, 38. Note that the shape of said cones imparts a slightly staggered stacking of items 14, as denoted by the reference numeral 38*a*. After machine operation has begun and at least one group of items 14 has entered sorter 10 when said cones were in their respective raised positions, when cones 36, 38 next rotate downwardly they will rest atop said items 14 as depicted in FIG. 5.

Advantageously, cones 36, 38 are mounted for rotation about their respective axes of symmetry. Thus, they rotate passively and substantially friction free as items 14 move away from them under the influence of second conveyor means 16. In this way, as said cones are performing their function of causing items 14 in a group to accumulate against said cones as depicted in FIGS. 4 and 5, they do not interfere with items 14 that have already encountered frustoconical member or members 32 as indicated in FIG. 5.

As the computer-controlled control means positions the cones in their "up" or "down" position, items 14 are sorted into transversely staggered groups as depicted in FIG. 1. The worker removing each independent group of items is therefore not required to make decisions regarding ambiguous groups as required with prior art systems. Just as importantly, second conveyor means 16 runs at a constant speed whenever it is operating, thereby eliminating the problems associated with variable speed conveyor means.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for sorting items to be mailed by grouping them into visually ascertainable distinct groups, said items being disposed in a generally horizontal plane, comprising:

a first conveyor means for transporting said items along a first path of travel;

at least one frustoconical member disposed in blocking relation to said first path of travel so that items following said first path of travel encounter said at least one frustoconical member and are constrained against further movement along said first path of travel;

a second conveyor means for transporting said items along a second path of travel normal to said first path of travel;

said second conveyor means having a first end disposed in cooperative relation to said at least one frustoconical member so that said items encountering said at least one frustoconical member are transported by said second conveyor means along said second path of travel;

a movably mounted barrier means disposed in alignment with said first conveyor means and in spaced apart relation to said at least one frustoconical member;

said barrier means having a first, raised position disposed in vertically spaced apart relation to said first conveyor means so that items following said first path of travel are unimpeded by said barrier means and therefore enter into abutting relation to said at least one frustoconical member and are carried along said second path of travel by said second conveyor means;

said barrier means having a second, lowered position disposed in blocking relation to items carried by said first conveyor means so that items following said first path of travel encounter said barrier means before reaching said at least one frustoconical member and are impeded from reaching said at least one frustoconical member, said items then being transported along said second path of travel by said second conveyor means; and control means for alternately raising and lowering said barrier means in response to predetermined input data relating to postal routes;

whereby said items are sorted into transversely staggered groups so that said groups are clearly and unambiguously distinguishable from one another; and whereby said second conveyor means operates at a constant, uniform speed.

2. The apparatus of claim 1, wherein said barrier means has a conical shape.

3. The apparatus of claim 2, wherein said barrier means includes a pair of cone-shaped members mounted in longitudinally spaced apart relation to one another so that items abutting said cone-shaped members are positioned substantially squarely relative to said first conveyor means.

4. The apparatus of claim 3, further comprising a mounting rod to which said pair of cone-shaped members are secured.

5. The apparatus of claim 4, further comprising a back wall to which said at least one frustoconical member is mounted, and a pair of transversely disposed, longitudinally spaced apart side walls secured to said back wall at opposite ends thereof, said mounting rod disposed in interconnecting relation to said side walls, said mounting rod being supported at its opposite ends by said side walls.

6. The apparatus of claim 5, wherein said mounting rod is rotatably mounted relative to said side walls so that said mounting rod is rotatable about its longitudinal axis of rotation.

7. The apparatus of claim 5, further comprising a flexible deflector band mounted to one of said side walls in depending relation therefrom to reduce the speed of items approaching said at least one frustoconical member that are unimpeded by said pair of cone-shaped members.

8. The apparatus of claim 5, further comprising a flexible deflector band mounted to said mounting rod to reduce the speed of items approaching said pair of cone-shaped members.

9. The apparatus of claim 3, wherein each cone-shaped member of said pair of cone-shaped members is mounted for rotation about its axis of symmetry so that it does not impede progress of items disposed in underlying relation thereto.

10. The apparatus of claim 1, further comprising a computer-controlled control means for raising and lowering said barrier means in response to data containing information abut postal routes so that said items are sorted into groups where each group includes items that share a predetermined postal designation.

11. The apparatus of claim 10, wherein said control means includes a cylinder having a plunger, said plunger being connected to a linkage that engages said mounting rod so that actuation of said plunger in a first, retracted direction rotates said mounting rod in a first direction, thereby lifting said barrier means and so that actuation of said plunger in a second, extended direction rotates said mounting rod in a second direction opposite to said first direction, thereby lowering said barrier means.

12. The apparatus of claim 1, wherein said at least one frustoconical member is rotatably mounted and has an angular velocity substantially matching a linear velocity of said second conveyor means.

13. An apparatus for sorting items to be mailed by grouping them into visually ascertainable distinct groups, said items being disposed in a generally horizontal plane, comprising:

a first conveyor means for transporting said items along a first path of travel;

a back wall disposed in blocking relation to said first path of travel;

a frustoconical member rotatably mounted to said back wall so that items following said first path of travel encounter said frustoconical member and are constrained against further movement along said first path of travel;

a second conveyor means for transporting said items along a second path of travel normal to said first path of travel;

said second conveyor means having a first end disposed in cooperative relation to said frustoconical member so that said items encountering said frustoconical member are transported by said second conveyor means along said second path of travel;

a pair of cone-shaped members mounted in longitudinally spaced apart relation to one another so that items abutting said cone-shaped members are positioned substantially squarely relative to said first conveyor means, said pair of cone-shaped members being in alignment with said first conveyor means and in spaced apart relation to said frustoconical member;

said pair of cone-shaped members having a first, raised position disposed in vertically spaced apart relation to said first conveyor means so that items following said first path of travel are unimpeded by said pair of cone-shaped members and therefore enter into abutting relation to said frustoconical member and are carried along said second path of travel by said second conveyor means;

said pair of cone-shaped members having a second, lowered position disposed in blocking relation to items carried by said first conveyor means so that items following said first path of travel encounter said pair of cone-shaped members before reaching said frustoconical member and are impeded from reaching said frustoconical member, said items then being transported along said second path of travel by said second conveyor means; and control means for alternately raising and lowering said pair of cone-shaped members means in response to predetermined input data relating to postal routes;

whereby said items are sorted into transversely staggered groups so that said groups are clearly and unambiguously distinguishable from one another.

14. The apparatus of claim 13, further comprising a mounting rod to which said pair of cone-shaped members are secured.

15. The apparatus of claim 14, further comprising a pair of transversely disposed, longitudinally spaced apart side walls secured to said back wall at opposite ends thereof, said mounting rod disposed in interconnecting relation to said side walls, said mounting rod being supported at its opposite ends by said side walls.

16. The apparatus of claim 15, wherein said mounting rod is rotatably mounted relative to said side walls so that said mounting rod is rotatable about its longitudinal axis of rotation.

17. The apparatus of claim 16, further comprising a computer-controlled control means for raising and lowering said pair of cone-shaped members in response to data containing information about postal routes so that said items are sorted into groups where each group includes items that share a predetermined postal designation.

18. The apparatus of claim 17, wherein said control means includes a cylinder having a plunger, said plunger being connected to a linkage that engages said mounting rod so that actuation of said plunger in a first, retracted direction rotates said mounting rod in a first direction, thereby lifting said pair of cone-shaped members and so that actuation of said plunger in a second, extended direction rotates said mounting rod in a second direction opposite to said first direction, thereby lowering said pair of cone-shaped members.

19. The apparatus of claim 13, wherein each cone-shaped member of said pair of cone-shaped members is mounted for rotation about its axis of symmetry so that it does not impede progress of items disposed in underlying relation thereto.

20. The apparatus of claim 13, wherein said frustoconical member is rotatably mounted to said back wall and has an angular velocity substantially matching a linear velocity of said second conveyor means.

* * * * *